US011540611B2

(12) United States Patent
Lee et al.

(10) Patent No.: US 11,540,611 B2
(45) Date of Patent: Jan. 3, 2023

(54) REFILL CONTAINER FOR COSMETIC COMPACT

(71) Applicant: NEWFRONTECH CO., LTD., Gyeonggido (KR)

(72) Inventors: Yong-jun Lee, Gyeonggi-do (KR); Jin-gee Kim, Gyeonggi-do (KR)

( * ) Notice: Subject to any disclaimer, the term of this patent is extended or adjusted under 35 U.S.C. 154(b) by 493 days.

(21) Appl. No.: 16/787,317

(22) Filed: Feb. 11, 2020

(65) Prior Publication Data

US 2020/0305573 A1 Oct. 1, 2020

(30) Foreign Application Priority Data

Mar. 29, 2019 (KR) ..... 10-2019-0036843
Jun. 20, 2019 (KR) ..... 10-2019-0073322

(51) Int. Cl.
*A45D 33/00* (2006.01)
*A45D 40/22* (2006.01)
*A45D 40/00* (2006.01)

(52) U.S. Cl.
CPC ..... *A45D 33/006* (2013.01); *A45D 40/22* (2013.01); *A45D 2033/001* (2013.01); *A45D 2040/0006* (2013.01); *A45D 2200/05* (2013.01)

(58) Field of Classification Search
CPC ..... A45D 33/006; A45D 40/22; A45D 2033/001; A45D 2040/0006; A45D 2200/05
USPC ..... 132/293
See application file for complete search history.

(56) References Cited

U.S. PATENT DOCUMENTS

2016/0235184 A1* 8/2016 Lee ..... B65D 51/18
2019/0090610 A1* 3/2019 Lee ..... A45D 33/006

FOREIGN PATENT DOCUMENTS

EP 3459387 A1 * 3/2019 ..... A45D 33/006
JP 2017099867 A * 6/2017 ..... A45D 33/008
KR 101466854 * 11/2014 ..... A45D 34/00
KR 20150010190 * 1/2015 ..... A45D 34/00
KR 20150087772 * 7/2015 ..... A45D 33/00

* cited by examiner

*Primary Examiner* — James N Smalley
(74) *Attorney, Agent, or Firm* — Schmeiser Olsen & Watts, LLP

(57) ABSTRACT

A refill container removably stored in a cosmetic compact includes: a main body being open at an upper part thereof and having a housing space inside thereof, an upper end sealing protrusion part, a lateral sealing protrusion part provided at an outer surface of the inner wall, and an outer wall being provided outside the inner wall with a predetermined gap therebetween; and a mesh fabric cover having a cylindrical first vertical extension part combined with the inner wall and the outer wall by being inserted into a gap provided therebetween such that an inner surface of the first vertical extension part is in close contact with the lateral sealing protrusion part, and a first rim part provided at an upper end of first vertical extension part.

4 Claims, 9 Drawing Sheets

REFILL CONTAINER FOR COSMETIC COMPACT

CROSS REFERENCE TO RELATED APPLICATION

The present application claims priority to Korean Patent Applications No. 10-2019-0036843, filed Mar. 29, 2019 and No. 10-2019-0073322, filed Jun. 20, 2019, the entire contents of which are incorporated herein for all purposes by this reference.

BACKGROUND OF THE INVENTION

Field of the Invention

The present invention generally relates to a refill container removably stored in a cosmetic compact. More particularly, the present invention relates to a refill container for a cosmetic compact for containing a liquid cosmetic.

Description of the Related Art

A conventional cosmetic compact having a refill container disclosed in Korean Patent No. 10-1466854 (registered on Nov. 24, 2014) and Korean Patent Application Publication No. 10-2015-0010190 (published on Jan. 28, 2015) is configured such that a porous pad, such as a sponge or foamed urethane foam, is stored in the refill container, and contents, i.e. a liquid cosmetic, are impregnated into the pad.

Unlike the conventional art, the present applicant has proposed a structure in which a liquid cosmetic is directly stored in the refill container without a pad in Korean Patent No. 10-1541396 (registered on Jul. 28, 2015), Korean Patent No. 10-1556904 (registered on Sep. 24, 2015), and Korean Patent No. 10-1851985 (registered on Apr. 19, 2018).

Meanwhile, in Korean Patent No. 10-1930227 (registered on Dec. 12, 2018), as is illustrated in FIG. 1, a technique for attaching a discharge plate 30 having multiple outlets 32 to the bottom surface of the combining structure of a fixer 70 covering a content container 10 and an elastic discharge mesh 20 has been proposed as a method of controlling the a liquid cosmetic of low viscosity.

SUMMARY OF THE INVENTION

Accordingly, the present invention has been made keeping in mind the above problems occurring in the related art, and the present invention is intended to propose a refill container for a cosmetic compact, in which a liquid cosmetic is directly contained without being impregnated to an impregnating pad, and especially, a sealing property is increased.

In order to achieve the above objectives, according to one aspect of the present invention, there is provided a refill container for a cosmetic compact removably stored in a lower casing of the cosmetic compact having an upper casing and the lower casing hinged to the upper casing, the refill container including: a main body being open at an upper part thereof and having an inner wall and an outer wall inside thereof, the inner wall defining a housing space and the outer wall being provided outside the inner wall with a predetermined gap therebetween, an upper end sealing protrusion part provided at an upper end part of the inner wall by protruding therefrom, and a lateral sealing protrusion part provided at an outer surface of the inner wall by protruding therefrom; a mesh fabric cover having: a cylindrical first vertical extension part combined with the inner wall and the outer wall by being inserted into a gap provided therebetween such that an inner surface of the first vertical extension part is in close contact with the lateral sealing protrusion part, a first rim part provided at an upper end of the first vertical extension part by extending by a predetermined width inward therefrom such that a lower surface of the first rim part is in close contact with the upper end sealing protrusion part, and a mesh fabric covering an upper part of the housing space by extending to an inner side of the first rim part; a sponge having a predetermined thickness upward and downward, the sponge being received to an inside of the vertical extension part and covering the housing space at a lower part of the mesh fabric; an auxiliary mesh fabric cover having: an auxiliary rim part received to the inside of the first vertical extension part such that an outer surface of the auxiliary rim part provided along an edge thereof is in contact with the inner surface of the first vertical extension part, and an auxiliary mesh fabric provided by extending to an inside of the auxiliary rim part, the auxiliary mesh fabric covering the housing space at a lower part of the sponge; and a valve plate interposed between the sponge and the auxiliary mesh fabric cover and being an elastic pad made of rubber or synthetic resin having a predetermined thickness, the valve plate being laminated and pressed by the sponge and the first rim part provided at an upper surface of the valve plate along the edge thereof and being laminated and pressed by the auxiliary rim part and an upper end part of the inner wall at a lower surface of the valve plate to be fixed by being in close contact therewith and having multiple cut lines provided in a plate surface thereof to pass through the cosmetics.

Here, the refill container may further include: a cover casing having: a cylindrical second vertical extension part being inserted into a gap provided between the inner wall and the outer wall together with the first vertical extension part while being in contact with an outer surface of the first vertical extension part such that the cylindrical second vertical extension part and the first vertical extension part are combined with the inner wall and the outer wall, and having a second protrusion part provided at a lower end part of an outer circumferential surface thereof; a second rim part provided at an upper end of the second vertical extension part by extending by a predetermined width inward therefrom and being in surface contact with the first rim part at a lower surface thereof; and an opening constituting an inside of the second rim part, wherein the main body may have a first protrusion part provided at a lower end part of the outer wall, so when the second vertical extension part is inserted into the gap, the first protrusion part and the second protrusion part may be configured to be engaged to each other to prevent the cover casing from being removed.

In addition, the lateral sealing protrusion part may be provided in plural, and the plurality of lateral sealing protrusion parts may be configured to be spaced apart from each other upward and downward.

Meanwhile, to achieve the above-described objectives, thee is provided the refill container for a cosmetic compact of the present invention includes: the main body being open at the upper part thereof and having the inner wall and the outer wall inside thereof, the inner wall defining the housing space and the outer wall being provided outside the inner wall with the predetermined gap therebetween, the upper end sealing protrusion part provided at the upper end part of the inner wall by protruding therefrom, and the lateral sealing protrusion part provided at the outer surface of the inner wall by protruding therefrom; the mesh fabric cover having: the cylindrical first vertical extension part combined with the inner wall and the outer wall by being inserted into the gap provided therebetween such that the inner surface of the first vertical extension part is in close contact with the lateral sealing protrusion part, the first rim part provided at the upper end of the first vertical extension part by extending by the predetermined width inward therefrom such that the lower surface of the first rim part is in close contact with the upper end sealing protrusion part, and the mesh fabric covering the upper part of the housing space by extending to the inner side of the first rim part; the sponge having the predetermined thickness upward and downward, the sponge being received to the inside of the first vertical extension part and covering the housing space at the lower part of the mesh fabric; and the auxiliary mesh fabric cover having: the auxiliary rim part received to the inside of the first vertical extension part such that the outer surface of the auxiliary rim part provided along the edge thereof is in contact with the inner surface of the first vertical extension part, and the auxiliary mesh fabric provided by extending to the inside of the auxiliary rim part, the auxiliary mesh fabric covering the housing space at the lower part of the sponge.

As described above, according to the refill container for a cosmetic compact of the present invention, the upper end sealing protrusion part is provided between the inner wall of the main body and the mesh fabric cover to be in close contact with the mesh fabric cover and the lateral sealing protrusion part is provided to be in close contact with the inner surface of the vertical extension part so that the liquid cosmetic does not escape along gaps, thereby increasing a sealing property.

In addition, according to the refill container for a cosmetic compact of the present invention, the escaping of the liquid cosmetic can be prevented by the valve plate provided together with the sponge between the mesh fabric cover and the auxiliary mesh fabric cover. Accordingly, the refill container for a cosmetic compact allows the sealing property to be improved and is suitable to contain a low viscosity cosmetic.

Furthermore, the refill container for a cosmetic compact according to the present invention is advantageous in terms of producers and consumers since the manufacturing process is simpler and productivity is higher than those of a prior art, thereby lowering the production cost.

BRIEF DESCRIPTION OF THE DRAWINGS

The above and other objects, features, and other advantages of the present invention will be more clearly understood from the following detailed description when taken in conjunction with the accompanying drawings, in which.

DETAILED DESCRIPTION OF THE INVENTION

Figure 1:
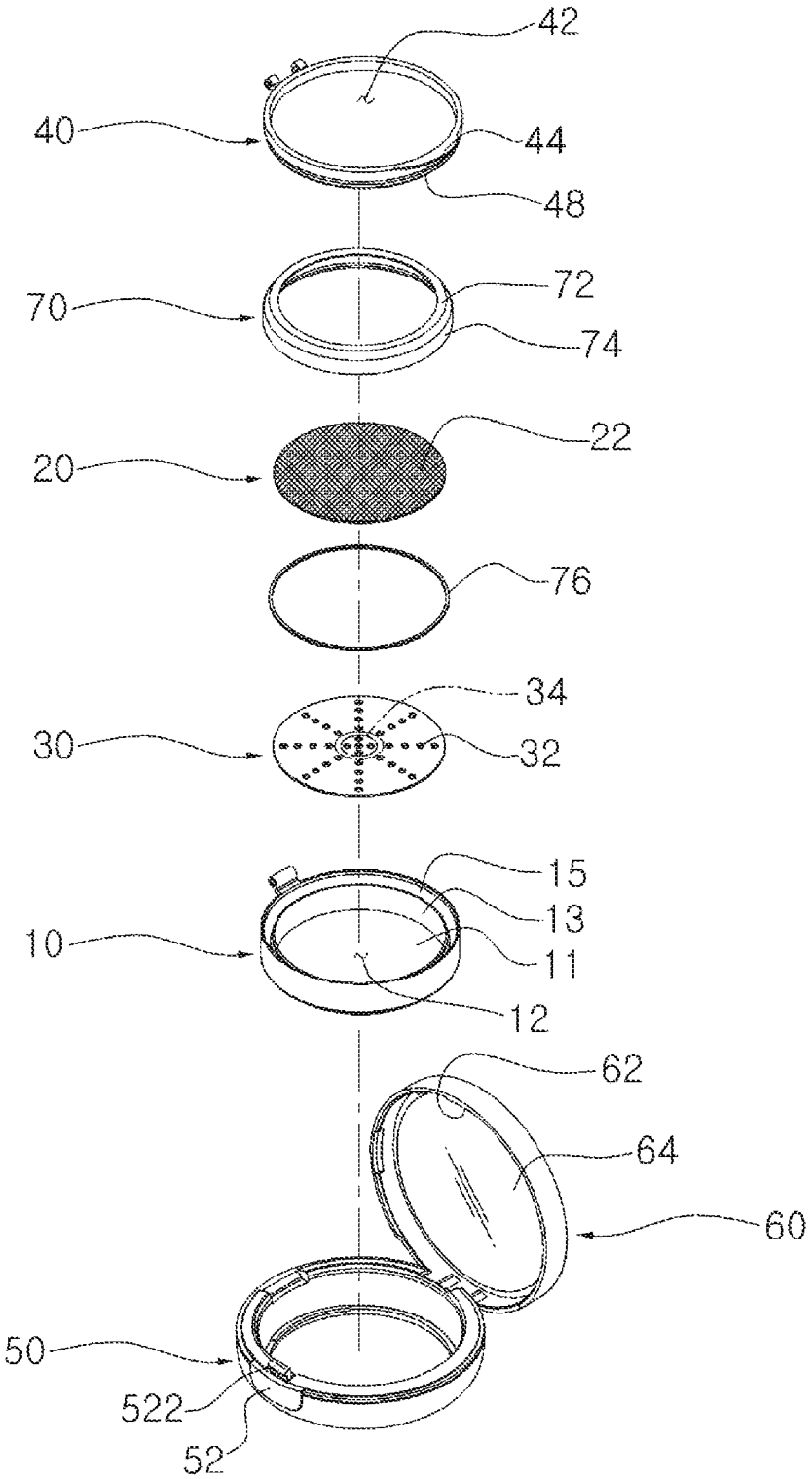
FIG. 1 (Prior Art)
FIG. 1 is a perspective view of a refill container for a cosmetic compact according to a conventional art.
Figure 2:
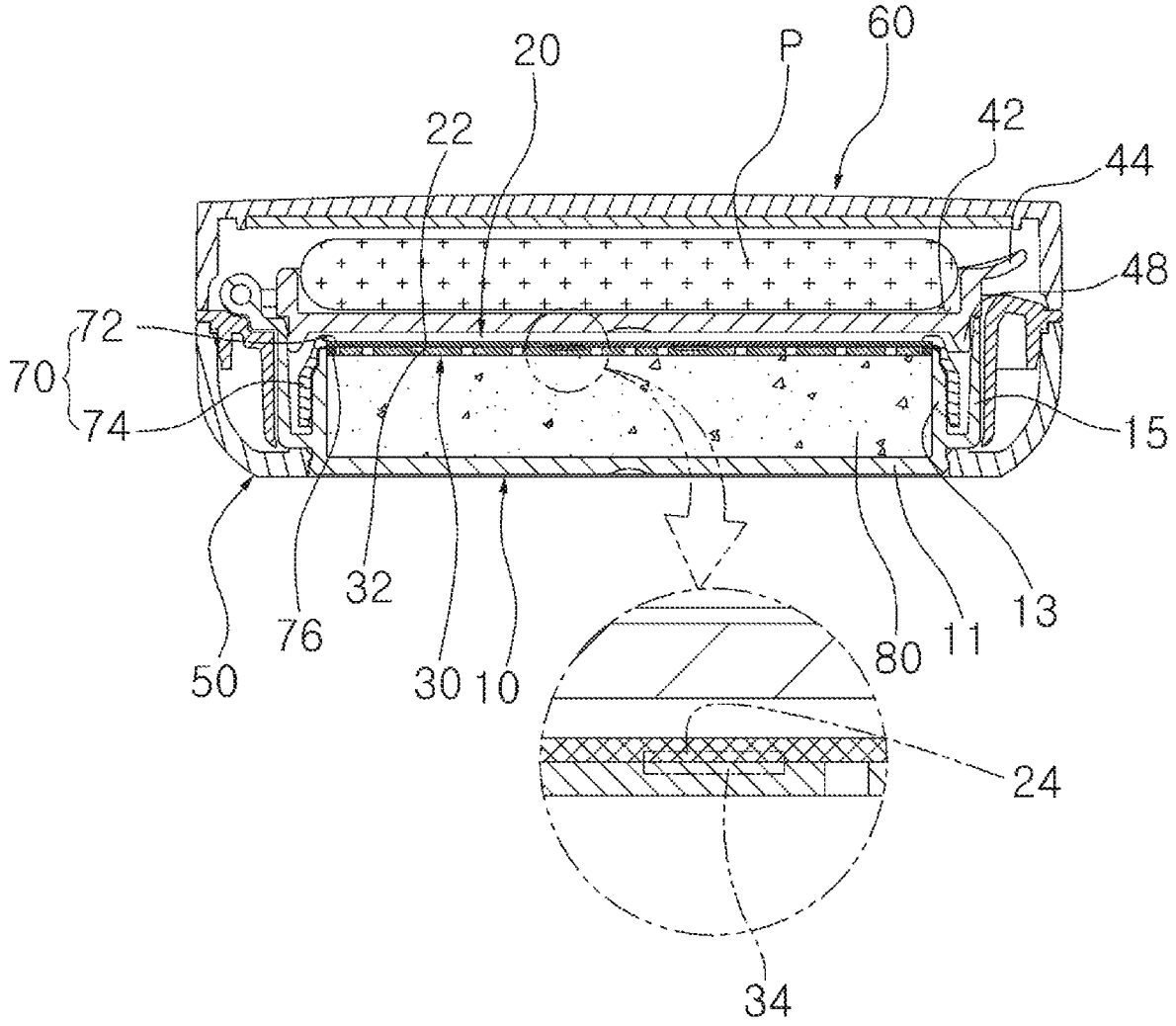
FIG. 2 (Prior Art)
FIG. 2 is a sectional view of the refill container for a cosmetic compact assembled of FIG. 1.
Figure 3:
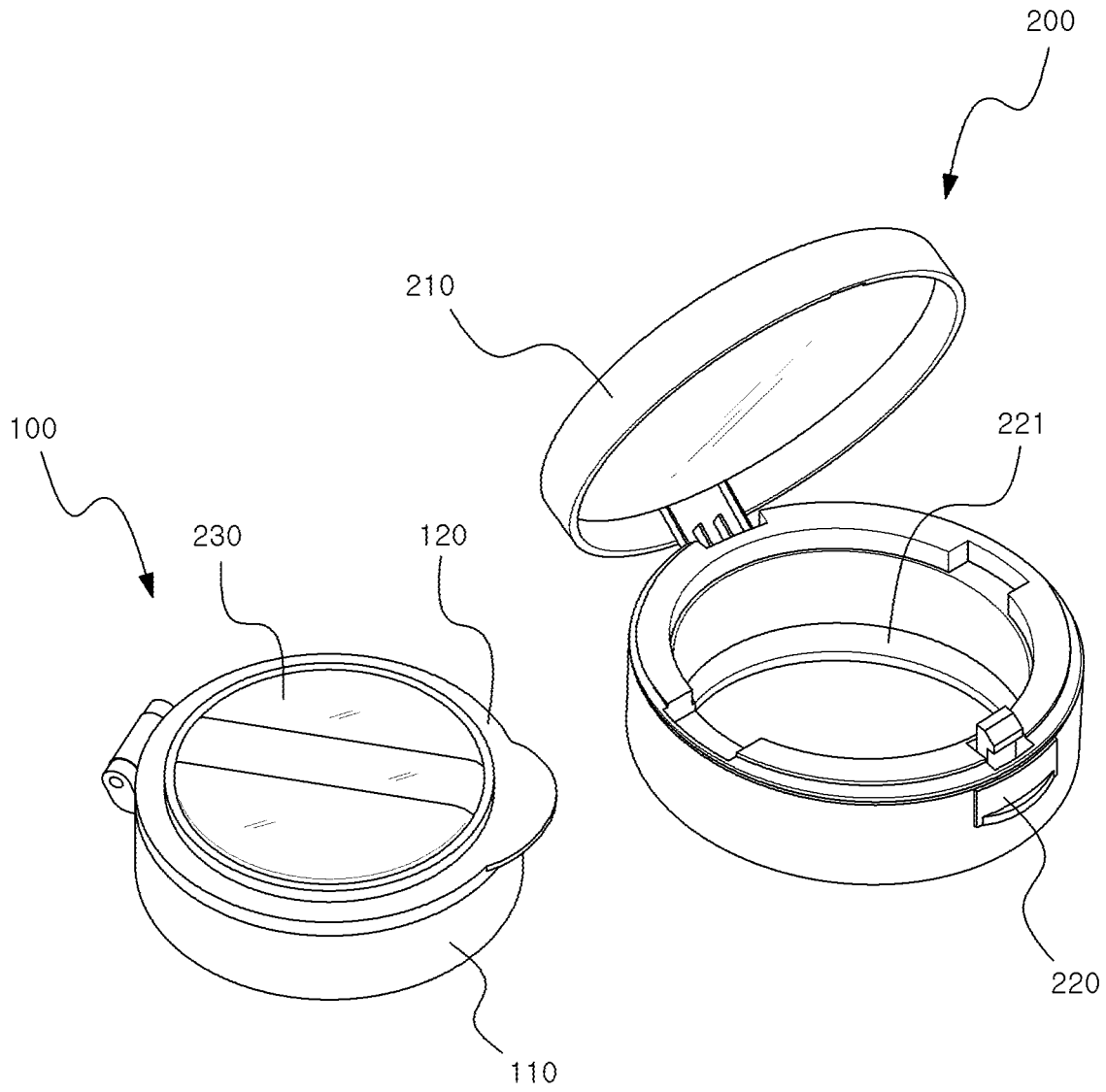
FIG. 3 is an exploded perspective view of a cosmetic compact including a refill container for the cosmetic compact according to the present invention.

As illustrated in FIG. 3, a refill container for a cosmetic compact 100 (hereinbelow, referred to as "a refill container") according to an embodiment of the present invention is stored in an upper casing 210 and a lower casing 220 of the cosmetic compact 200, the lower casing 220 being hinged to the upper casing 210 and when cosmetics stored inside the refill container are exhausted, the refill container is removed from the casings and discarded, and a new refill container 100 is received thereto. Such a refill container 100 is removably received into a housing space 221 of the lower casing 220.

Figure 4:
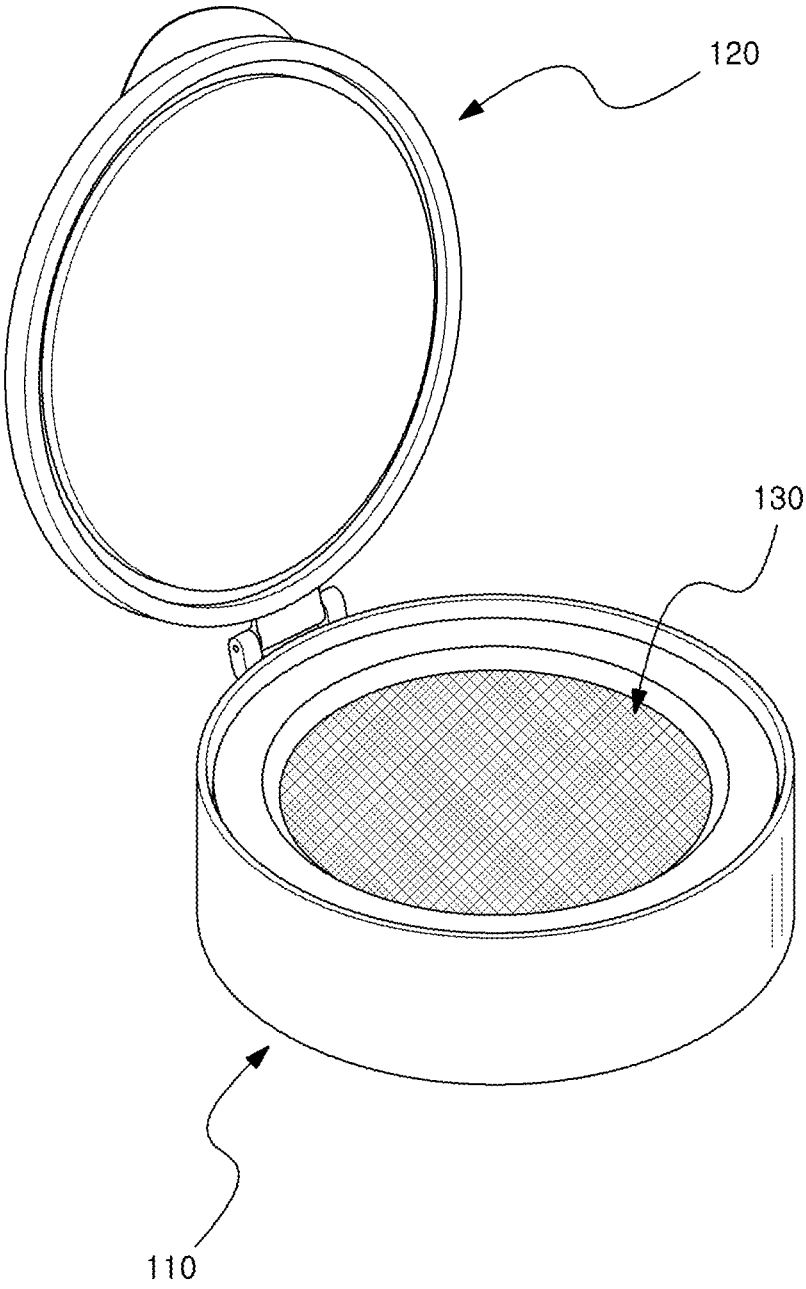
FIG. 4 is an open perspective view of the refill container for a cosmetic compact of FIG. 3.
Figure 5:
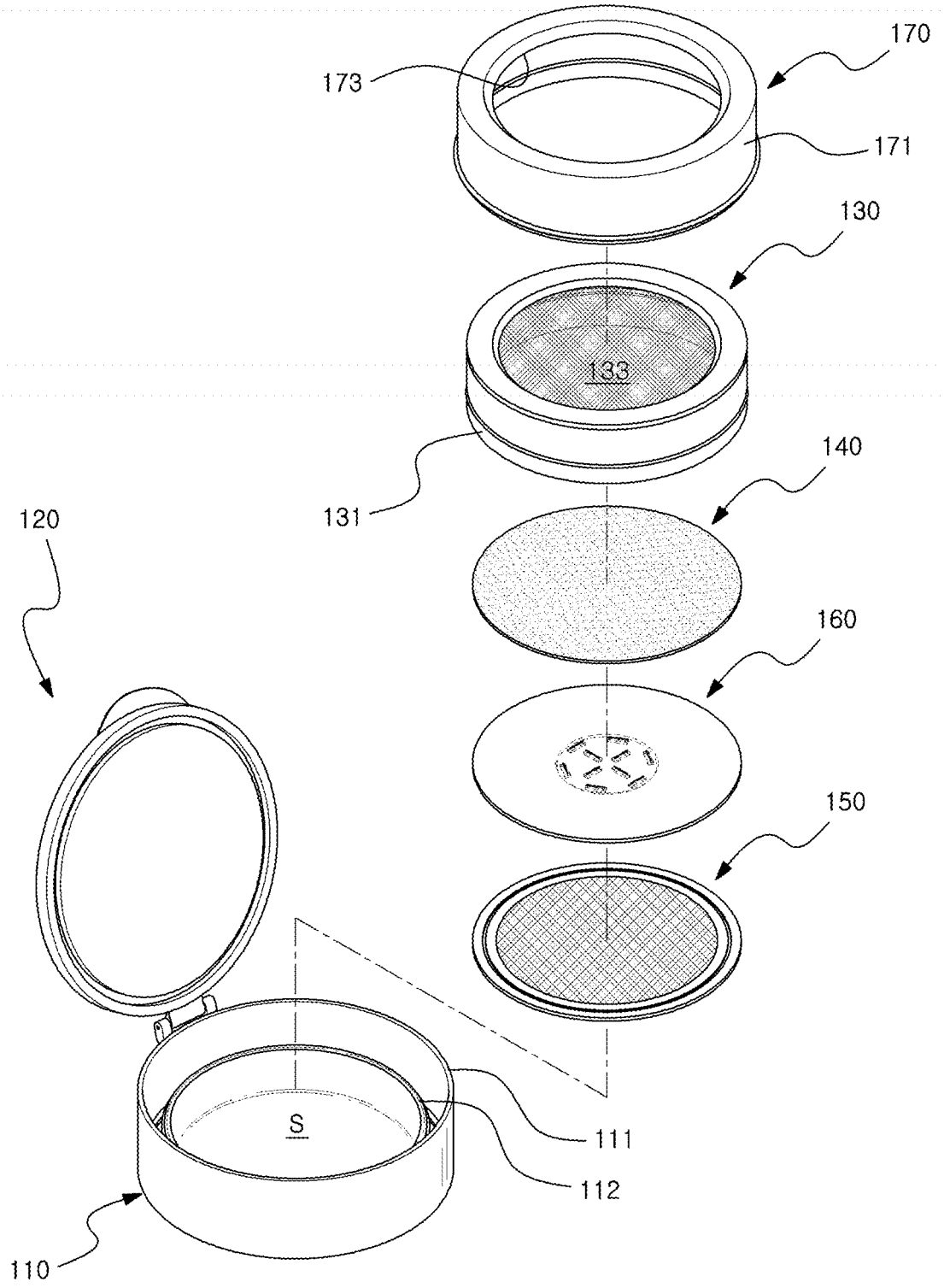
FIG. 5 is an exploded perspective view of the refill container for a cosmetic compact of FIG. 4.

As illustrated in FIGS. 3 to 5, the refill container 100 includes a main body 110 being open at an upper part thereof and a container cover 120 rotatably combined with the main body, the container cover covering or opening the main body 110.

A liquid cosmetic is received into a housing space S provided inside the main body 110, and as inner covers covering the housing space, a mesh fabric cover 130, a sponge 140, a valve plate 160, and an auxiliary mesh fabric cover 150 are provided separately and are combined with each other upward and downward, and finally, are received into and combined with a cover casing 170 to cover the housing space S.

Accordingly, the cosmetics of the housing space S can be supplied by passing through the auxiliary mesh fabric cover 150, the valve plate 160, the sponge 140, and the mesh fabric cover 130. That is, in the state of FIG. 4, when the mesh fabric cover 130 is pressed by a puff 230 of FIG. 3, the cosmetics of the housing space S ooze through the auxiliary mesh fabric cover 150, the valve plate 160, the sponge 140, and the mesh fabric cover 130 and smear on the puff 230.

Figure 6:
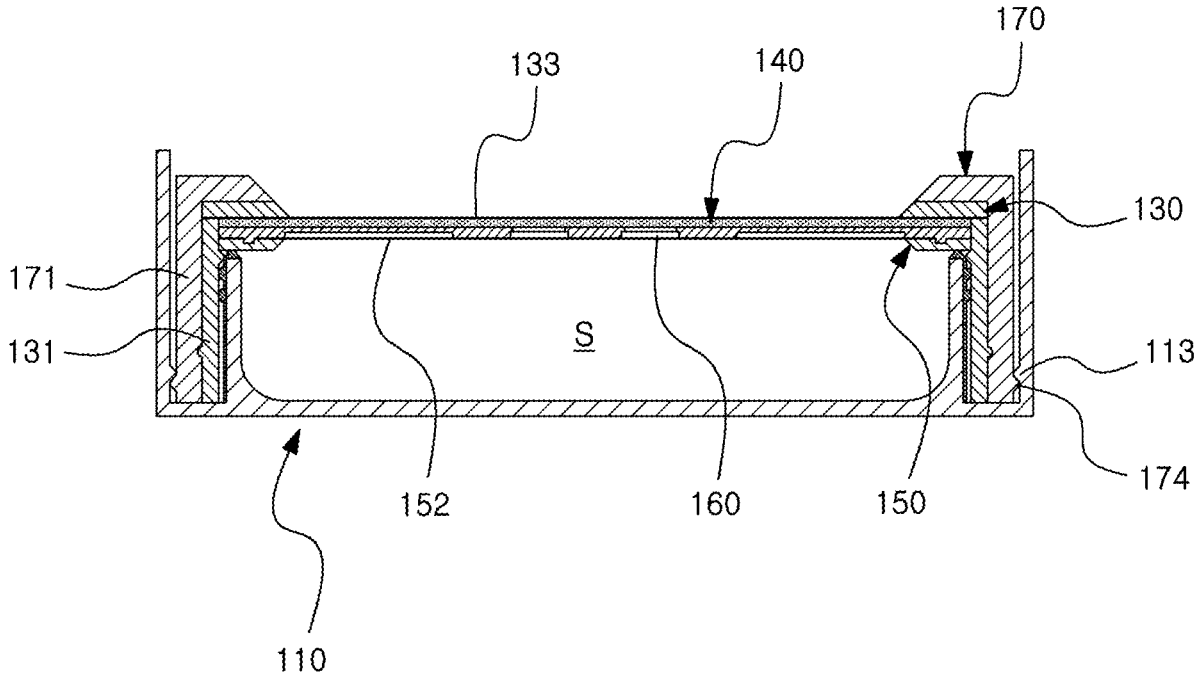
FIG. 6 is a sectional view of the refill container for a cosmetic compact of FIG. 4.
Figure 7:
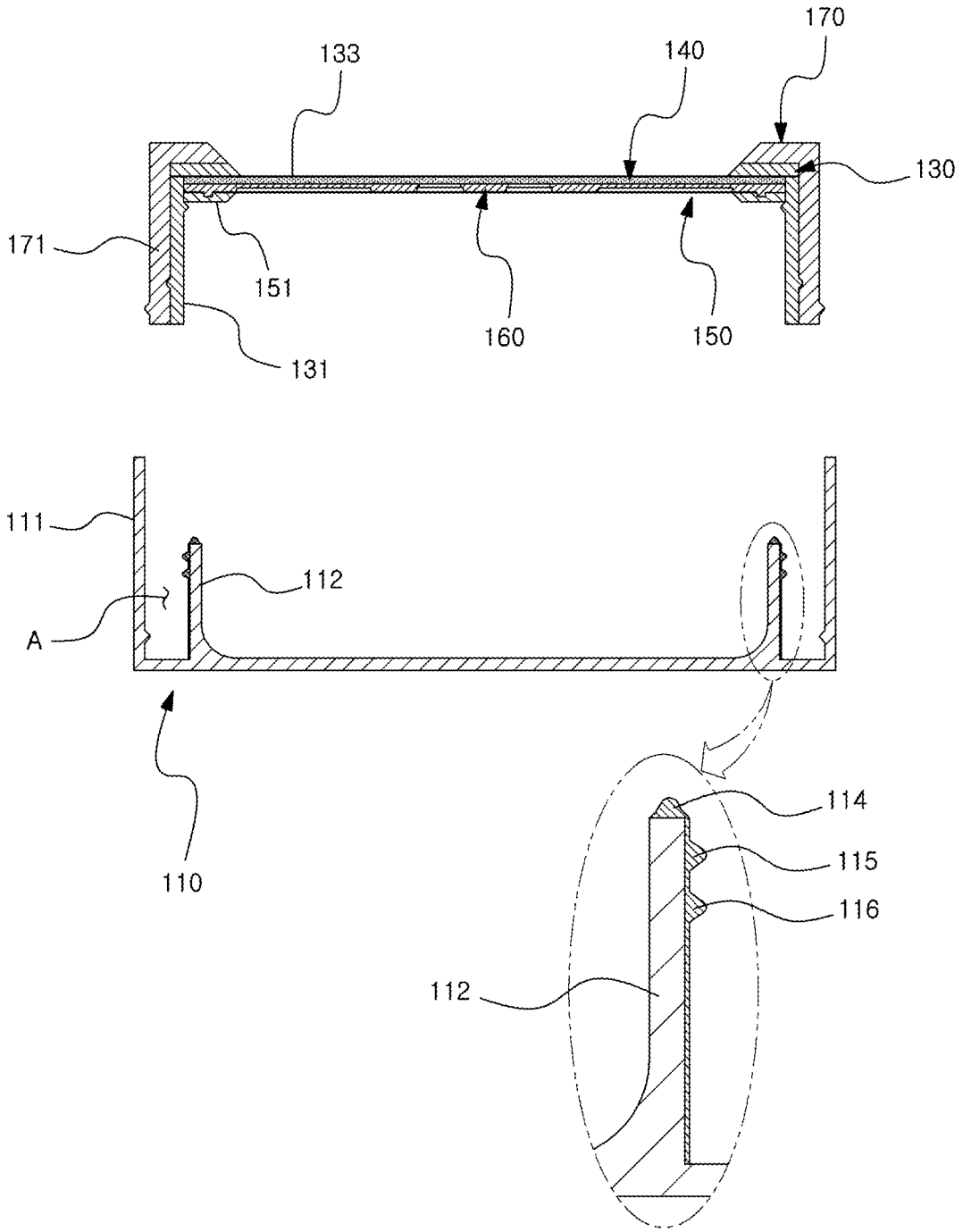
FIG. 7 is a partially exploded sectional view of the refill container for a cosmetic compact of FIG. 6.
Figure 8:
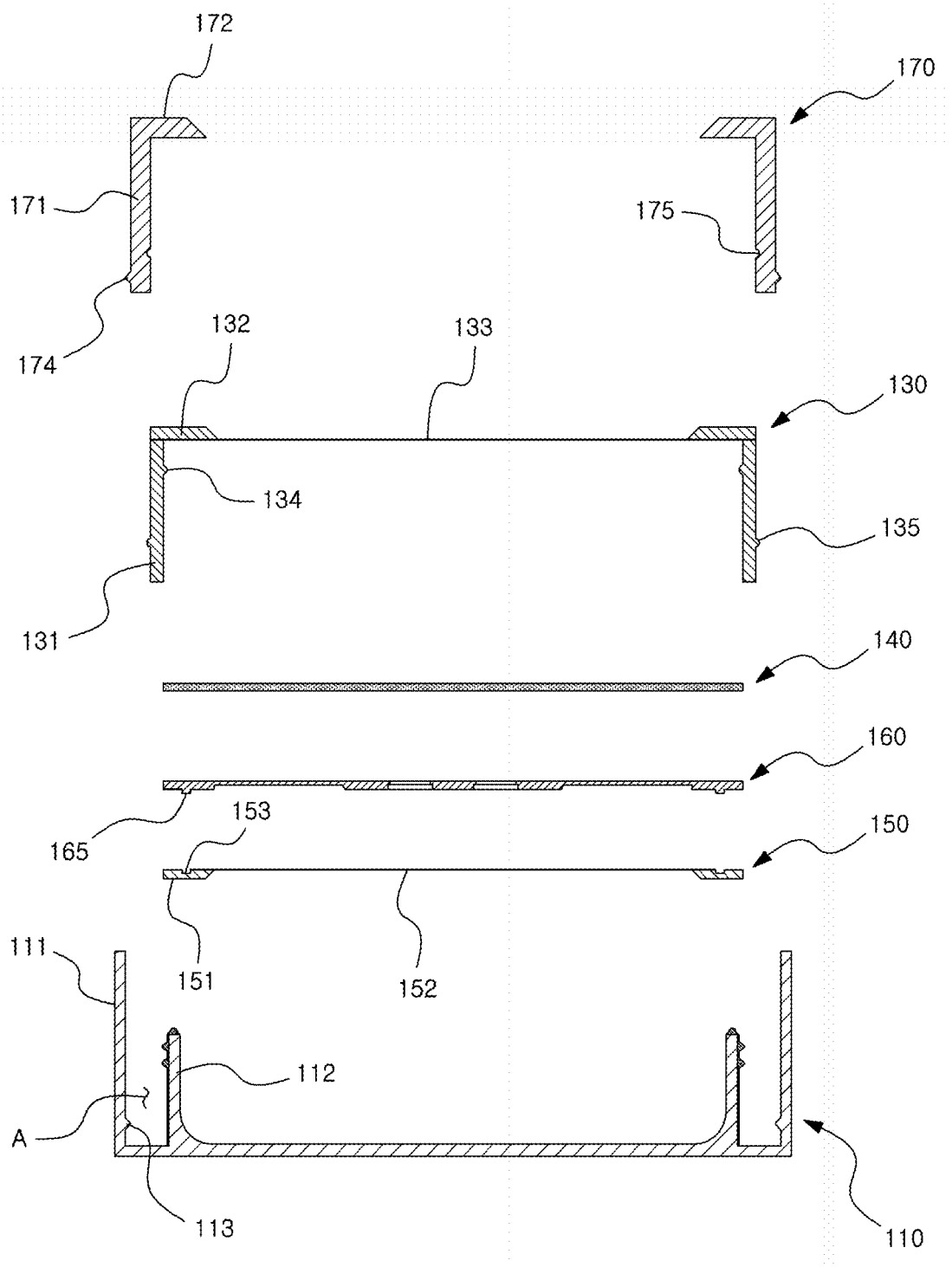
FIG. 8 is an entirely exploded sectional view of the refill container for a cosmetic compact of FIG. 6.

The main body 110 is configured to include an outer wall 111 and an inner wall 112 with a predetermined gap A of FIG. 7 therebetween, and the housing space S is provided inside the inner wall 112. Furthermore, as illustrated in FIGS. 6 to 8, cylindrical second and first vertical extension parts 171 and 131 of the cover casing 170 and the mesh fabric cover 130, respectively, are combined with the inner wall 112 and the outer wall 111 by being inserted to the gap A defined between the inner wall 112 and the outer wall 111, with the cylindrical second and first vertical extension parts 171 and 131 being in contact with each other. In this case, a second protrusion part 174 is formed at a lower end part of an outer circumferential surface of the second vertical extension part 171, and in response, a first protrusion part 113 is formed at an inner circumferential surface of the outer wall 111, so the second protrusion part 174 and the first protrusion part 113 are engaged with each other up and down. Accordingly, the cover casing 170 and the mesh fabric cover 130 inserted into the gap are prevented from deviating.

A second rim part 172 is provided at an upper end of the second vertical extension part 171 by extending by a predetermined width inward therefrom and an open hole 173 of FIG. 5 is provided at an inner side of the second rim part 172.

A first rim part 132 being in surface contact with the second rim part 172 upward and downward is provided at an upper end of the first vertical extension part 131 by extending by a predetermined width inward therefrom, and a mesh fabric 133 is interposed between the upper surface of the first vertical extension part 131 and the lower surface of the first rim part 132, and upper and lower surfaces of the mesh fabric 133 are integrally formed with the upper end of the first vertical extension part 131 and an outer end part of the first rim part 132 by being interposed therebetween along the edge thereof. Accordingly, the mesh fabric 133 covers the upper part of the housing space S.

As illustrated in FIGS. 5 to 8, the sponge 140, the valve plate 160, and the auxiliary mesh fabric cover 150 may be further provided under the mesh fabric cover 130. The sponge 140 is configured to have a predetermined thickness upward and downward and is housed in the mesh fabric cover 130 such that an outer surface of the sponge provided along the edge thereof is in contact with an inner surface of the first vertical extension part 131 provided at a side of the mesh fabric cover 130. In this state, the sponge 140 covers the housing space S at the lower part of the mesh fabric 133 as illustrated in FIG. 5.

The auxiliary mesh fabric cover 150 provided under the sponge 140 with the valve plate 160 interposed therebetween is housed in the mesh fabric cover 130 such that the outer surface of an auxiliary rim part 151 formed along the edge thereof is in contact with the inner surface of the first vertical extension part 131 at the side of the mesh fabric cover 130, and an auxiliary mesh fabric 152 is formed to be integrated with the auxiliary rim part 151 by extending therefrom to the inner side thereof. Accordingly, the auxiliary mesh fabric 152 covers the housing space S under the sponge 140.

The valve plate 160 is an elastic pad interposed between the sponge 140 on the upper side thereof and the auxiliary mesh fabric cover 150 on the lower side thereof, the elastic pad being made of rubber or synthetic resin having a predetermined thickness, and nitrile butadiene rubber (NBR) and elastomer may be included in the material of the valve plate. As illustrated in FIGS. 6 to 8, such a valve plate 160 is laminated and pressed by the sponge 140 and the first rim part 132 provided at an upper surface of the valve plate 160 along the edge thereof and is laminated and pressed by the auxiliary rim part 151 and an upper end part of the inner wall 112 at a lower surface of the valve plate to be fixed by being in close contact therewith.

Meanwhile, as illustrated in the enlarged view of FIG. 7, an upper end sealing protrusion part 114 and a pair of lateral sealing protrusion parts 115 and 116 are integrally formed on the upper end part and an outer circumferential surface of the inner wall 112, respectively, by injection-molding elastomer. Accordingly, during the combination of the cover casing 170 with the mesh fabric cover 130, the lateral sealing protrusion parts 115 and 116 are in close contact with the inner surface of the first vertical extension part 131 inserted to the gap A by being in contact and being pressed, and the upper end sealing protrusion part 114 is in close contact with a lower surface of the auxiliary rim part 151 of the auxiliary mesh fabric cover 150 by being in contact therewith and being pressed.

Accordingly, due to the above-described sealing structure, the liquid cosmetic contained in the housing space S is prevented from escaping due to the total triple sealing of sealing by the upper end sealing protrusion part 114 and the auxiliary rim part 151, and double sealing by the lateral sealing protrusion parts 115 and 116 and the first vertical extension part 131, so that the cosmetics is prevented from escaping over walls of a gap A due to a capillary phenomenon. The liquid cosmetic can be discharged to the outside only by passing through the mesh fabric 133 only by pressing the puff 230 of FIG. 3.

In FIGS. 7 and 8, a protrusion part 134 provided on the upper end part of an inner circumferential surface of the first vertical extension part 131 supports an outer end part of the auxiliary rim part 151 (see FIG. 7) after the sponge 140, the valve plate 160, and the auxiliary rim part 151 are inserted to the inside of the first vertical extension part 131 prior to the combination of the first vertical extension part 131 with the main body 110, thereby preventing the sponge 140, the valve plate 160, and the auxiliary mesh fabric cover 150 inserted to the inside of the first vertical extension part 131 from being removed. Accordingly, the refill container 100 can be easily assembled and the modularization of the assembly is realized.

A protrusion part 135 formed on an outer circumferential surface of the first vertical extension part 131 by protruding therefrom is fitted to a groove part 175 recessed in an inner circumferential surface of the second vertical extension part 171 at a side of the cover casing 170 so that the fitting is not easily released (see FIG. 7).

Figure 9:
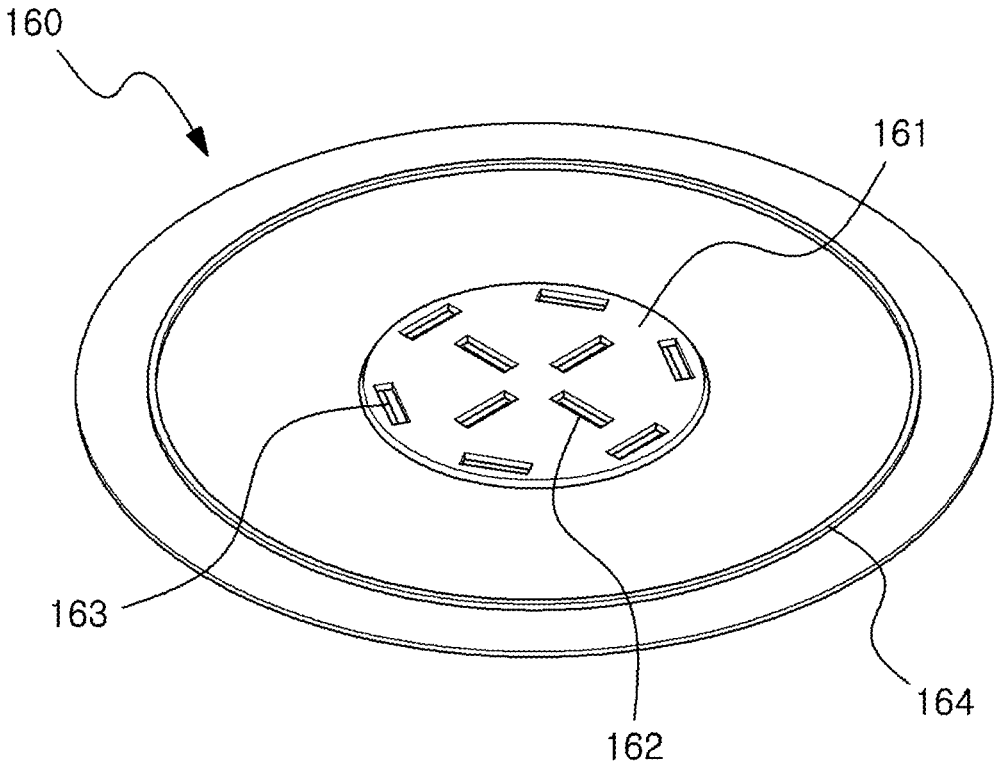
FIG. 9 is a bottom perspective view of a valve plate, which is a component of the refill container for a cosmetic compact of FIG. 5.

As illustrated in FIGS. 5, 8, and 9, the valve plate 160 includes a protruding end part 161 having a predetermined radius provided at a center of a lower surface thereof, wherein cut lines 162 having a cross shape and cut lines 163 are provided on a surface thereof, the cut lines 163 being arranged on a circumference of the cut lines 162 in a circumferential direction thereof.

Accordingly, when a user presses down the mesh fabric 133 by using the puff 230 of FIG. 3 in the assembled state of FIG. 6, the valve plate 160 is pressed down and elastically transformed. Accordingly, the cut lines 162 and 163 are opened, so the cosmetics contained in the housing space S under the mesh fabric 133 leak out and smear on the puff 230. Normally, the cut lines 162 and 163 are not opened to be maintained in a closed state, so the housing space S is controlled such that the cosmetics contained in the housing space do not easily leak out.

Even when the valve plate 160 is repeatedly pressed, the edge of the valve plate 160 is laminated and pressed by the first rim part 132, the sponge 140, the auxiliary rim part 151, and the upper end part of the inner wall 112, which are laminated upward and downward as described above, to be fixed thereto. Accordingly, the valve plate 160 is not easily deviated and the cosmetics in the housing space S can be prevented from escaping through the edge.

Referring to FIG. 8, a protrusion 165 is formed on a lower surface of an edge area of the valve plate 160, and in response, a groove part 153 is formed on an upper surface of the auxiliary rim part 151. The fitting of the protrusion 165 into a groove part 153 prevents the valve plate 160 from being removed from the fixed position when the valve plate 160 is pushed and pressed by the puff.

In FIG. 9, the distribution and number of the cut lines 162 and 163 famed on the valve plate 160 may be various to control the discharge amount of the cosmetic.

The refill container for a cosmetic compact 100 described above is only an embodiment to help the understanding of the present invention, and thus the scope of the present invention should not be understood as being limited to the above description. The scope of the invention to the technical scope of the present invention is defined by the claims to be described later and their equivalents.

What is claimed is:

1. A refill container for a cosmetic compact removably stored in a lower casing of the cosmetic compact, the lower casing being hingedly connected to an upper casing of the cosmetic compact, the refill container comprising:

a main body being open at an upper part thereof and having an inner wall and an outer wall, the inner wall defining a housing space and the outer wall being provided outside the inner wall with a predetermined gap therebetween, an upper end sealing protrusion part provided at an upper end part of the inner wall by protruding from the upper end part of the inner wall, and a lateral sealing protrusion part provided at an outer surface of the inner wall by protruding from the outer surface of the inner wall;

a mesh fabric cover having: a cylindrical first vertical extension part combined with the inner wall and the outer wall by being inserted into the predetermined gap such that an inner surface of the first vertical extension part is in close contact with the lateral sealing protrusion part, a first rim part provided at an upper end of the first vertical extension part by extending by a predetermined width inward from the first vertical extension part such that a lower surface of the first rim part is in close contact with the upper end sealing protrusion part, and a mesh fabric covering an upper part of the housing space by extending to an inner side of the first rim part;

a sponge having a predetermined thickness, the sponge being received to an inside of the vertical extension part and covering the housing space at a lower part of the mesh fabric;

an auxiliary mesh fabric cover having: an auxiliary rim part received to the inside of the first vertical extension part such that an outer surface of the auxiliary rim part provided along an edge thereof is in contact with the inner surface of the first vertical extension part, and an auxiliary mesh fabric provided by extending to an inside of the auxiliary rim part, the auxiliary mesh fabric covering the housing space at a lower part of the sponge; and a valve plate interposed between the sponge and the auxiliary mesh fabric cover and being an elastic pad made of rubber or synthetic resin having a predetermined thickness, the valve plate being laminated and pressed by the sponge and the first rim part provided at an upper surface of the valve plate along the edge thereof and being laminated and pressed by the auxiliary rim part and an upper end part of the inner wall at a lower surface of the valve plate to be fixed by being in close contact with the sponge and the auxiliary rim part and having multiple cut lines provided in a plate surface thereof to permit the cosmetics to pass through the multiple cut lines.

2. The refill container of claim 1, further comprising: a cover casing having:

a cylindrical second vertical extension part being inserted into a gap provided between the inner wall and the outer wall together with the first vertical extension part while being in contact with an outer surface of the first vertical extension part such that the cylindrical second vertical extension part and the first vertical extension part are combined with the inner wall and the outer wall, and having a second protrusion part provided at a lower end part of an outer circumferential surface thereof;

a second rim part provided at an upper end of the second vertical extension part by extending by a predetermined width inward from the second vertical extension part and being in surface contact with the first rim part at a lower surface of the second rim part; and an opening constituting an inside of the second rim part, wherein the main body has a first protrusion part provided at a lower end part of the outer wall, so when the second vertical extension part is inserted into the gap, the first protrusion part and the second protrusion part are engaged to each other to prevent the cover casing from being removed.

3. The refill container of claim 1, wherein the lateral sealing protrusion part is provided in plural, the plurality of lateral sealing protrusion parts being spaced apart from each other.

4. A refill container for a cosmetic compact removably stored in a lower casing of the cosmetic compact, the lower casing being hingedly connected to an upper casing of the cosmetic compact, the refill container comprising:

a main body being open at an upper part thereof and having an inner wall and an outer wall, the inner wall defining a housing space and the outer wall being provided outside the inner wall with a predetermined gap between the inner wall and the outer wall, an upper end sealing protrusion part provided at an upper end part of the inner wall by protruding from the upper end part of the inner wall, and a lateral sealing protrusion part provided at an outer surface of the inner wall by protruding from the inner wall;

a mesh fabric cover having: a cylindrical first vertical extension part combined with the inner wall and the outer wall by being inserted into the predetermined gap such that an inner surface of the first vertical extension part is in close contact with the lateral sealing protrusion part, a first rim part provided at an upper end of the first vertical extension part by extending by a predetermined width inward from the first vertical extension part such that a lower surface of the first rim part is in close contact with the upper end sealing protrusion part, and a mesh fabric covering an upper part of the housing space by extending to an inner side of the first rim part;

a sponge having a predetermined thickness upward and downward, the sponge being received to an inside of the first vertical extension part and covering the housing space at a lower part of the mesh fabric; and an auxiliary mesh fabric cover having: an auxiliary rim part received to the inside of the first vertical extension part such that an outer surface of the auxiliary rim part provided along an edge thereof is in contact with the inner surface of the first vertical extension part, and an auxiliary mesh fabric provided by extending to an inside of the auxiliary rim part, the auxiliary mesh fabric covering the housing space at a lower part of the sponge.

* * * * *